US005373994A

United States Patent [19]

Hunt

[11] Patent Number: 5,373,994

[45] Date of Patent: Dec. 20, 1994

[54] BALL MILL CAN POSITIONING DEVICE

[75] Inventor: Thomas J. Hunt, Peekskill, N.Y.

[73] Assignee: Materials Research Corporation, Orangeburg, N.Y.

[21] Appl. No.: 99,185

[22] Filed: Jul. 29, 1993

[51] Int. Cl.[5] ..... B02C 17/00; B02C 17/04

[52] U.S. Cl. ..... 241/30; 241/177; 241/178

[58] Field of Search ..... 241/174, 176, 177, 178, 241/30

[56] References Cited

U.S. PATENT DOCUMENTS

| | | | |
|---|---|---|---|
| 1,309,210 | 7/1919 | Marcy | 241/176 |
| 2,510,858 | 6/1950 | Black . | |
| 2,551,774 | 5/1951 | Traylor, Jr. | 241/178 |
| 2,819,130 | 1/1958 | Kaminsky | 241/178 |
| 2,873,072 | 2/1959 | Farkas . | |
| 3,185,192 | 5/1965 | Delcellier | 241/178 |
| 3,216,666 | 11/1965 | Svensson et al. | 241/176 |
| 3,521,825 | 7/1970 | Morcom . | |
| 4,226,271 | 10/1980 | Coleman | 144/208 B |
| 4,265,408 | 5/1981 | Voelskow | 241/87 |
| 4,995,561 | 2/1991 | Yukimi | 241/62 |
| 5,114,084 | 5/1992 | Yamaguchi et al. | 241/178 |

FOREIGN PATENT DOCUMENTS

| | | |
|---|---|---|
| 550777 | 7/1993 | European Pat. Off. . |
| 2385937 | 10/1978 | France . |
| 2812985 | 10/1978 | Germany . |
| 1063963 | 4/1967 | United Kingdom . |

*Primary Examiner*—Mark Rosenbaum
*Assistant Examiner*—John M. Husar
*Attorney, Agent, or Firm*—Wood, Herron & Evans

[57] ABSTRACT

An automatic positioning device for a ball mill can allows an operator to set a ball mill can on the rollers of a ball mill stand without centering or modifying the position of the can. The positioning device includes a mounting fixture secured to the ball mill stand at the end of a generally cylindrical ball mill can. The mounting fixture has a bore hole through which is inserted a post. The post is capable of rotating within the bore hole and has a generally U-shaped yoke secured to an end thereof which extends from the mounting fixture toward a bottom end wall of the ball mill can. Mounted on a pin between the yoke arms is a circular disk which is free to spin about the pin within the yoke. The positioning device is mounted on the ball mill stand such that a peripheral edge of the disk contacts the bottom end wall of the ball mill can during the milling process. Minimal frictional wear results between the disk and the ball mill can because the disk is free to spin about the pin with the rotation of the ball mill can. The disk is also free to pivot relative to a plane containing the disk in association with the rotation of the post within the bore hole thereby enabling the disk to freely position itself in a proper tangential orientation to the rotation of the ball mill can rather than having to be positioned in a labor intensive and time consuming process by the operator.

12 Claims, 2 Drawing Sheets

BALL MILL CAN POSITIONING DEVICE

FIELD OF THE INVENTION

This invention relates to the field of powder metals preparation. More particularly, it is an improvement on the ball milling process to allow an operator to set up a ball mill can on the rollers of a ball mill stand without centering or modifying the position of the can.

BACKGROUND OF THE INVENTION

In the preparation of powder metals a ball mill can contains the bulk metal and a powderizing media typically a quantity of hardened spherical balls. The powderizing media converts the bulk metal to powder form when the ball mill can is repeatedly tumbled or rotated in a specifically designed and regulated process.

Ball mill cans are made in varying sizes and of various materials. Typically, a ball mill can is cylindrical having a solid bottom end wall opposite a top end wall which includes a closure device specifically designed to contain the metal powders and media within the ball mill can.

The ball mill can is tumbled or rotated using a ball mill stand. The ball mitt stand includes a number of rotationally driven rollers onto which the ball mill can is positioned :and supported. A circumferential side wall of the ball mill can is positioned atop the rollers such that a longitudinal axis of the ball mill can is generally parallel to the underlying rollers.

The use of the ball mill stand as described for varying sizes of ball mill cans has led to a time consuming practice of centering or modifying the position of the ball mill can on the rollers so that the ball mill can does not contact or rub the stationary surfaces of the ball mill stand. Frictional contact between the stationary surfaces of the ball mill stand and the ball mill can during the milling process is a problem because it leads to the wear and degradation of the ball mill can and the ball mill stand, thereby lessening the useful life of each, In addition to the need to avoid the frictional contact between the ball mill can and the stand, the ball mill can must be accurately positioned and centered on the rollers to avoid shifting of the ball mill can during the milling process which could lead to a deviation in the milling process and the resulting powder metal.

Prior solutions to the problem of using various sizes of ball mill cans on a ball mill stand include securing a section of channel or angle metal to the stand to position the can atop the rollers. The section of angle metal may or may not include a Teflon facing. However, the continuous frictional contact between the ball mill can and the angle metal during the milling process caused wear to the ball mill can as well as the positioning angle metal thereby shortening the life of each component. Furthermore, the rubbing contact between the ball mill can and the angle metal causes a variation in the rotational speed of the ball mill can which introduces possible milling process deviation. Therefore, the use of an angle metal secured to the ball mill stand has proven to be inadequate.

Another previous solution to the problem of positioning the ball mill can atop the rollers was for the operator to layer masking tape in various locations on the circumference of the ball mill can. Alternatively, large rubber bands placed in various locations on the ball mill can circumference have been used to position the can. The disadvantage of these approaches is that they require approximately ten minutes of operator time to accurately position the ball mill can, This increased operator time devoted to positioning the ball mill can results in increased downtime and inefficiency in the milling process. The increased operator time likewise increases the cost of the milling process in preparation of powder metals.

As evidenced by the above background, a need exists for an automatic positioning device for a ball mill can used on a ball mill stand in the preparation of powder metals. Particularly, the positioning device for the ball mill can should be automatic or require little or no operator time and be applicable for various sizes of ball mill cans and avoid the degradation or wearing away of the ball can and ball mill stand during the milling process.

SUMMARY OF THE INVENTION

This invention is directed to an automatic positioning device for a ball mill can mounted atop the rollers of a ball mill stand. The automatic ball mill can positioning device is clipped onto the surface of a ball mill stand near the bottom end wall ofthe ball mill can. The invention accomplishes the task of automatically positioning various sizes of ball mill cans placed on the rollers without additional effort or time by the operator. Furthermore, no wear or degradation on the ball mill can results from rubbing contact between the ball mill can and the ball mill stand during the milling process. The result is less damage to both the ball mill can and the ball mill stand and therefore a longer useful life for each component. The positioning of the device of the present invention introduces no perceivable effect upon the rotational speed of the ball mill can during the milling process and, therefore, no process deviation in the production of powder metals. The present invention additionally offers quieter operation with less operator distraction than previous solutions to the problem of positioning various sizes of ball mill cans on the ball mill stand.

The ball mill can automatic positioning device of the present invention includes a generally circular wheel or disk in which the outer edge of the disk is in contact with the end wall of the ball mill can during the milling process. The disk is mounted both for rotation about an axis passing through the center of the disk and for pivoting relative to a plane containing the disk. Mounted to both rotate and pivot, the disk positions itself in a proper tangential orientation to the rotation of the ball mill can while in contact with the bottom end wall of the can. The ability to pivot relative to a horizontal plane permits the disk and positioning device to be used with various size ball mill cans having different diameters of end walls without added operator set-up or positioning time. Furthermore, the ability of the disk to pivot compensates :for minor alignment variations between the positioning device and the ball mill can. The ability of the disk to rotate about a central axis perpendicular to the its major axis in response to the rotation of the ball mill can atop the rollers avoids the frictional wear of the ball mill can and stand associated with the fixed positioning devices previously described.

The disk rotates: about a pin mounted through the center of the disk and supported by a yoke. The yoke is generally U-shaped having a pair of parallel arms to which the pin is secured at the terminal end of each yoke arm. The disk rotates about the pin and between the arms of the yoke.

The yoke is fixed to one end of a post. The post is mounted within a bore hole formed in a mounting fixture. The yoke is fixed to an end of the post extending out of the bore hole. The post is capable of rotating approximately 60° about its longitudinal axis within the bore hole of the mounting fixture. A slot is formed in a base portion of the mounting fixture for the attachment of the mounting fixture to the ball mill stand by clipping the slot to the stand.

The mounting fixture is mounted to the ball mill stand so that the outer edge of the disk:contacts the end wall of the ball mill can during the milling process. The disk is free to spin or rotate about the pin between the arms of the yoke resulting in minimal frictional wear between the disk and the ball mill can. Furthermore, because the post and yoke are capable of rotating within the bore hole of the mounting fixture, the disk pivots relative to a plane containing the disk in order to align itself in a proper tangential orientation to the rotation of the ball mill can rather than having to be positioned in a time consuming process by the operator. The disk is capable of pivoting a total of approximately 60° in order to properly align itself with the ball mill can rotation.

The above features and advantages of the present invention will be better understood in reference to the accompanying figures and detailed description. It should be understood that the particular specifications, configurations, or geometrical relationships of the ball mill can positioning device are exemplary only and are not to be regarded as limitations on the invention.

BRIEF DESCRIPTION OF THE DRAWINGS

Reference is now made to the accompanying drawings from which the novel features and advantages of the present invention will be apparent.

DETAILED DESCRIPTION OF THE INVENTION

Figure 1:
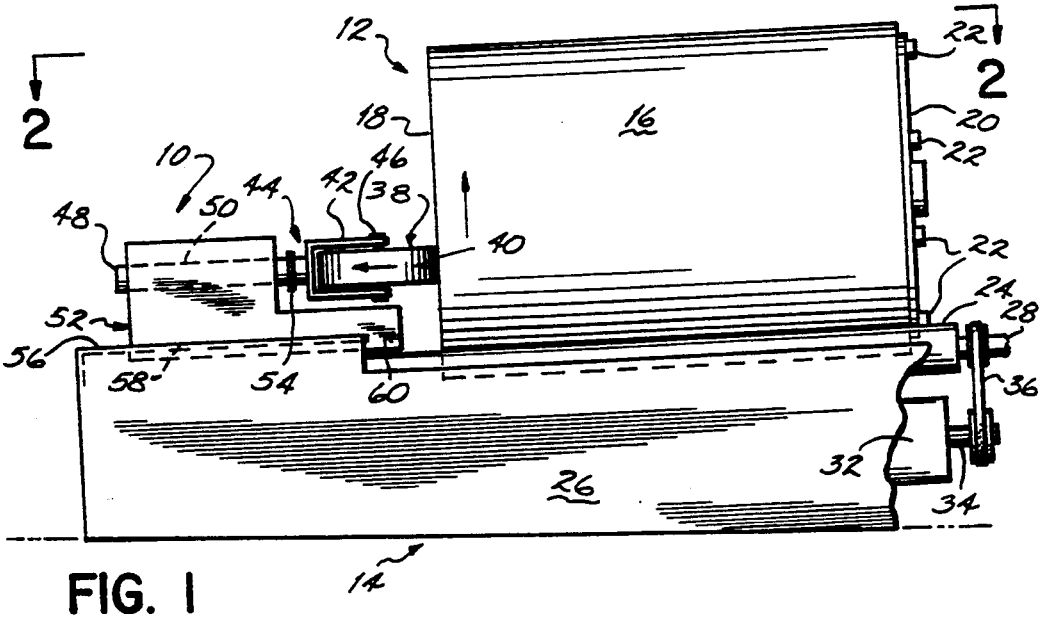
FIG. 1 is a side elevational view of a ball mill can, a ball mill stand, and an automatic positioning device according to the present invention.

Referring to FIG. 1, a position device 10 for a ball mill can 12 is shown clipped to a ball mill stand 14. The ball mill can 12 is cylindrical with a circumferential side wall 16 joining a solid end wall 18 and a selectively removable end cap 20. The end cap 20 is secured to the ball mill can 12 with mounting bolts 22 to thereby form a tight seal to contain the metal and powderizing media or milling balls (not shown) within the ball mill can 12.

Figure 2:
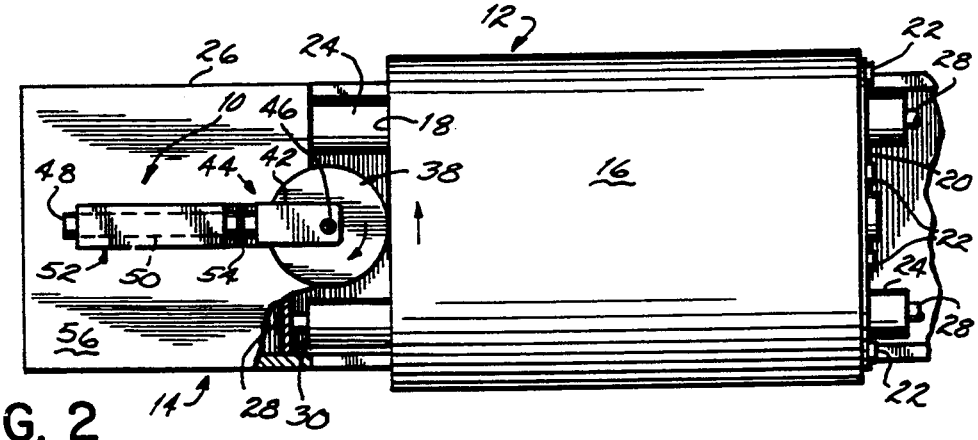
FIG. 2 is a top view of the ball mill can, the ball mill stand, and the positioning device of FIG. 1 taken along line 2—2.
Figure 3:
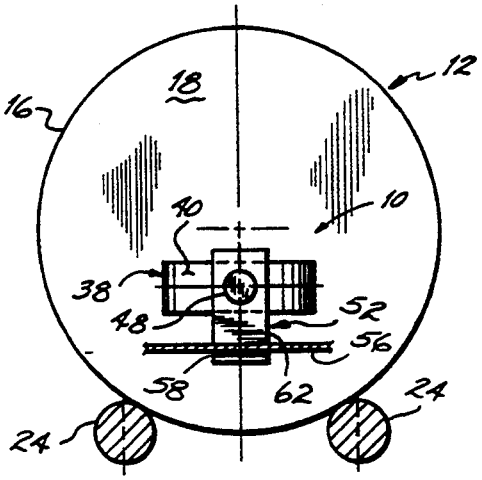
FIG. 3 is a diagrammatic end view of the bottom of the ball mill can in contact with a disk of the automatic positioning device.

As shown in both FIGS. 1 and 2, the ball mill can 12 is positioned on the ball mill stand 14 with the circumferential side wall 16 of the ball mill can 12 being supported by rollers 24 mounted in a ball mill stand housing 26. Each roller 24 is mounted upon an axle 28 for rotation. Each axle 28 is mounted within the ball mill stand housing by a bracket 30 to allow for the rotation of each roller 24 and axle 28 combination. As shown in FIG. 1, each roller 24 is rotationally driven by a motor 32 having a drive shaft 34 which is coupled to each axle 28 by a belt 36 thereby transmitting the rotational energy generated by the motor from the drive shaft 34 to the axle 28. It will be appreciated by one of ordinary skill in the art, that the ball mill can, ball mill stand and structure for rotationally driving the rollers are conventional and the automatic positioning device can be employed with other sizes of ball mill cans and designs of ball mill stands within the scope of the present invention.

The positioning device 10 includes a circular disk 38 in which an outer peripheral edge 40 of the disk 38 is in frictional contact with the end wall 18 of the ball mill can 12. The contact between the disk 38 and the ball mill can 12 is maintained during the milling process by gravitational forces resulting from the inclination of the ball mill can 12 and ball mill stand 14 relative to a horizontal plane. The disk 38 is mounted for rotation between a pair of arms 42 of a generally U-shaped yoke 44. The disk 38 rotates freely on a pin 46 extending through the center of the disk 38 and secured to the terminal end of each yoke arm 42. The pin 46 extends through the center of the disk 38 to provide for non-eccentric rotation of the disk 38 about the pin 46.

The U-shaped yoke 44 is secured to the end of an elongated cylindrical post 48, The post 48 is inserted through a bore hole 50 in a generally L-shaped mounting fixture 52. The post 48 is mounted within the bore hole 50 to permit the rotation of the post 48 within the bore hole 50, thereby pivoting the disk 38 attached to the yoke 44 at the end of the post 48 relative to a horizontal plane. A metal washer 54 is positioned on the post between the yoke 44 and the mounting fixture 52.

Figure 5:
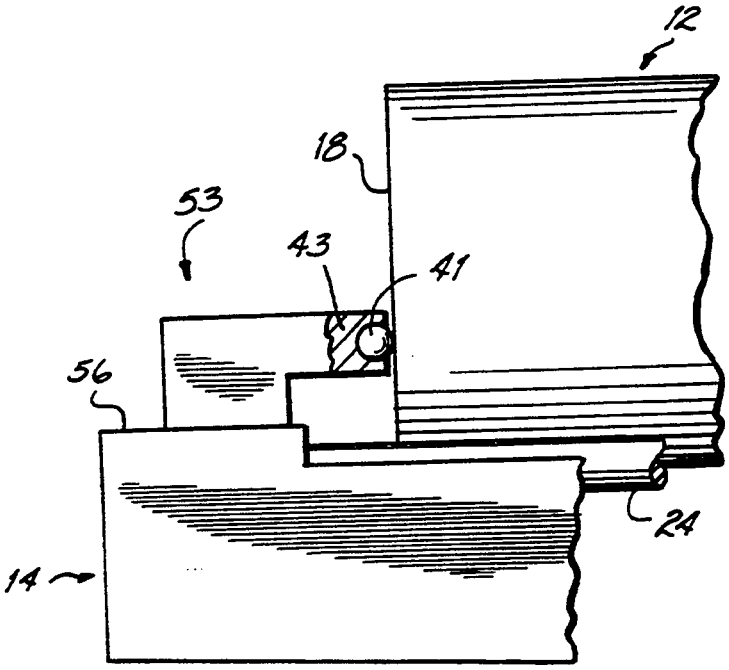
FIG. 5 is a side elevational view of a second embodiment of this invention.

In an alternative embodiment of this invention, the disk 38 is replaced by a ball bearing 41 supported in a socket 43 for free-floating non-eccentric rotation as shown in FIG. 5. The outer surface of the ball bearing 41, or other comparable spherical mechanism, is in contact with the end wall 18 of the ball mill can 12 during the milling process and the socket is secured to a mounting fixture 53 attached to the ball mill stand 14. The socket 43 houses the ball bearing 41 permitting the ball bearing to freely rotate therein. With this embodiment, the socket 43 and ball bearing 41 are not required to pivot relative to a horizontal plane due to the multidirectional rotating capability of the ball bearing 41 when in contact with the ball mill can 12, The mounting fixture 53 is secured to an upper portion 56 of the ball mill stand 14.

The mounting fixture 52 for the disk 38 is secured to an upper portion 56 of the ball mill stand housing 26 by a slot 58 formed in the bottom portion of the mounting fixture 52. The slot 58 permits the mounting fixture 52 to be clipped to the upper portion 56 of the ball mill stand housing 26.

In the preferred embodiment of the automatic positioning device 10 of the present invention, the mounting fixture 52 is constructed of aluminum L-shaped block about 0.5 inches thick having a long leg 60 and a short leg 62. The bore hole 50 is 5/16 of an inch in diameter and extends parallel to the long leg and through the short leg 62 of the mounting fixture 52. The slot 58 cut into the long leg 60 is approximately 0.06 inches thick and positioned approximately 0.75 inches below the bore hole 50 and is generally parallel with the long leg 60 of the mounting fixture 52. The slot 58 extends approximately three-quarters of the length of the long leg 60 of the mounting fixture 52.

Each yoke arm 42 is approximately 2.5 inches in length. The disk 38 is 2.0 inches in diameter and is centered between the yoke arms 42 on the pin 46 which is secured at the terminal ends of each yoke arm 42. In addition to being mounted for rotation on the pin 46 between the yoke arms 42, the disk 38 is free to pivot relative to a horizontal plane approximately 30° in both the positive and negative directions.

Figure 4:
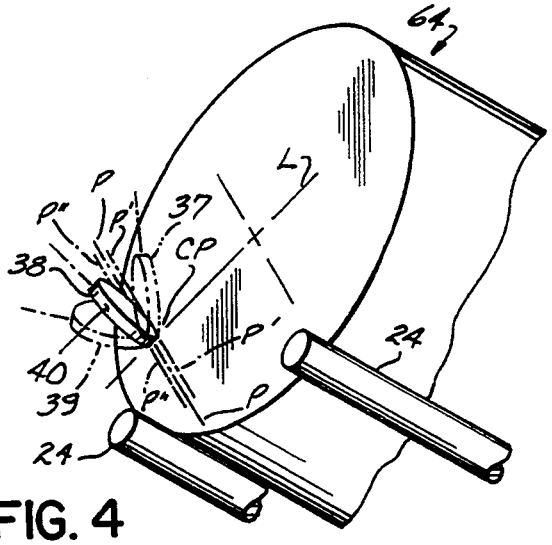
FIG. 4 is a perspective bottom view of the ball mill can and the disk showing the proper geometric relationships thereof.

As shown in FIG. 4, the proper orientation of the disk 38 relative to the end wall 18 of the ball mill can 12 is dependant upon a line L passing through the center C of the end wall 18 and the contact point CP of the peripheral edge of the disk 38 with the end wall 18. A projection P of the disk 38 in a direction containing the plane of the disk onto the end wall 18 must be perpendicular to the line L for the proper operation of the positioning device of this invention. Therefore, the disk 38 will rotate about the pin 46 in a proper tangential relationship with the rotation of the disk without undue friction or wear to either component.

Furthermore, the disk 38 should be in a plane perpendicular to the end wall 18 for optimum operation of the positioning device; however, the disk 38 will also position the ball mill can 12 according to this invention even if the disk 38 is obliquely angled relative to the end wall 18 as shown by disks 37 and 39 in FIG. 4, provided that the projections P′ and P″ of disks 37 and 39, respectively, are perpendicular to line L as previously described in reference to projection P.

In operation, the metal to be converted to powder and the powderizing media, i.e. milling balls, are placed within the ball mill can 12. The end cap 20 is then secured on to the ball mill can 12 by the bolts 22, thereby forming a sealed closure of the ball mill can 12 in preparation for the milling process.

The ball mill can 12 is then positioned on the rollers 24 of the ball mill stand 14 with the longitudinal axis of the ball mill can 12 being generally parallel with the longitudinal axis of the rollers 24. The circumferential side wall 16 of the ball mill can 12 is supported by the rollers 24 such that the rotation of the rollers 24 is transferred to the ball mill can 12 thereby initiating the milling process.

An operator places the ball mill can 12 on the ball mill stand 14 with the end wall of the ball mill can 12 in contact with the peripheral edge 40 of the disk 38 of the automatic positioning device 10. The ball mill can 12 is merely placed on the rollers 24 of the ball mill stand 14 without the time consuming and labor intensive task of centering or positioning the can with the prior devices previously described. The can 12 is automatically centered and positioned on the ball mill stand 14 once the rotation of the rollers and ball mill can 12 is initiated. Any variations in size of the ball mill can 12 or alignment between the can 12 and the positioning device 10 are compensated for by the pivoting disk 38.

The disk 38 in contact with the end wall 18 of the ball mill 12 freely spins about the pin 46 as the ball mill can 12 is rotated, thereby generating minimal friction between the positioning device 10 and the ball mill can 12. The disk 38 is also capable of pivoting due to the ability of the post 48 to rotate within the bore hole 50 of the mounting fixture 52, thereby enabling the disk 38 to position itself in a proper tangential orientation to the rotation of the ball mill can 12 rather than having to be positioned by the operator. The automatic positioning device 10 of the present invention can be used with varying sizes of ball mill cans thereby eliminating the labor intensive and time consuming tasks of reconfiguring the ball mill stand or modifying the different size ball mill cans.

It will be appreciated by one of ordinary skill in the art that the positioning device of the present invention is not limited to the specific configurations or geometric relationships described in reference to the preferred embodiment. Likewise, the positioning device can be attached with screws, rivets, or other conventional fasteners as alternatives to the slot for securing the mounting fixture to the ball mill stand within the scope of the present invention.

From the above disclosure and the general principals and preceding detailed description of the preferred embodiment, those skilled in the art will readily comprehend the various modifications to which the present invention is susceptible. Therefore, I desire to be limited only by the scope of the following claims and equivalents thereof:

What is claimed is:

1. A method of ball milling with ball mill cans of different sizes, each of the differently sized ball mill cans having a cylindrical side wall and a pair of end walls, the method comprising:

sequentially placing at least two ball mill cans of different sizes on a can rotating assembly which is dimensioned and configured to accommodate a range of sizes of ball mill cans without precise positioning of said can on said can rotating assembly and adjustments by an operator, said cans being placed on said can rotating assembly for rotation with their cylindrical side walls in contact with said can rotating assembly;

sequentially contacting only a first one of said end walls of each differently sized ball mill can when placed on said can rotating assembly with an edge of a generally circular disk, a second one of said end walls being uncontacted by a can positioning element when said can is on said can rotating assembly, said disk being mounted both for non-eccentric rotation and for pivotal movement so that a projection of said disk onto said first end wall of said can being rotated by said can rotating assembly in a direction containing the plane of said disk is perpendicular to a line joining said contact point and the center of said first end wall; and sequentially rotating each said can while its cylindrical wall is supported on said can rotating assembly, its first end wall is in contact with said disk, and its second end wall is uncontacted by a can positioning element.

2. A method of ball milling with ball mill cans of different sizes, each of the differently sized ball mill cans having a cylindrical side wall and a pair of end walls, the method comprising:

sequentially placing at least two ball mill cans of different sizes on a can rotating assembly which is dimensioned and configured to accommodate a range of sizes of ball mill cans without precise positioning of said can on said can rotating assembly and adjustments by an operator, said cans being placed on said can rotating assembly for rotation with their cylindrical side walls in contact with said can rotating assembly;

sequentially contacting only a first one of said end walls of each differently sized ball mill can when placed on said can rotating assembly with an edge of a generally circular disk, a second one of said end walls being uncontacted by a can positioning element when said can is on said can rotating assembly, said disk being perpendicular to said first end wall and being mounted both for non-eccentric rotation and for pivotal movement so that a projection of said disk onto said first end wall of said can being rotated by said can rotating assembly in a direction containing the plane of said disk is perpendicular to a line joining said contact point and the center of said first end wall; and sequentially rotating each said can while its cylindrical wall is supported on said can rotating assembly, its first end wall is in contact with said disk, and its second end wall is uncontacted by a can positioning element.

3. A method of ball milling with ball mill cans of different sizes, each of the differently sized ball mill cans having a cylindrical side wall and a pair of end walls, the method comprising:

sequentially placing at least two ball mill cans of different sizes on a can rotating assembly which is dimensioned and configured to accommodate a range of sizes of ball mill cans without precise positioning of said can on said can rotating assembly and adjustments by an operator, said cans being placed on said can rotating assembly for rotation with their cylindrical side walls in contact with said can rotating assembly;

sequentially contacting only a first one of said end walls of each differently sized ball mill can when placed on said can rotating assembly with a generally spherical ball bearing being mounted for rotation, a second one of said end walls being uncontacted by a can positioning element when said can is on said can rotating assembly; and sequentially rotating each said can while its cylindrical wall is supported on said can rotating assembly, its first end wall is in contact with said ball bearing, and its second end is uncontacted by a can positioning element.

4. A ball mill comprising:

a support frame;

a generally cylindrical ball mill can having a pair of end walls, a cylindrical side wall, and a longitudinal axis of symmetry;

a can rotating assembly mounted on said support frame adapted to contact said cylindrical side wall when said ball mill can is supported thereon, said can being rotated about its axis of symmetry when supported with its cylindrical side wall in contact with said can rotating assembly;

a rotational member having an outer surface contacting a first one of said end walls of said ball mill can when said can is supported by said can rotating assembly, a second one of said end walls being uncontacted by a can positioning element when said can is rotated on said can rotating assembly; and a mounting assembly supported on said frame, said mounting assembly rotatably supporting said rotational member for both non-eccentric rotation and for pivotal movement, said rotational member, said mounting assembly and said can rotating assembly being dimensioned and configured to accommodate a range of sizes of said ball mill can without precise positioning of said can on said can rotating assembly and adjustments by an operator.

5. The ball mill of claim 4 wherein said can rotating assembly comprises a ball mill can stand and a plurality of rotationally driven rollers rotatably mounted on said ball mill can stand, said ball mill can being supported by said rollers on a circumferential side wall of said can, said rollers frictionally engaging said circumferential side wall and thereby rotating said ball mill can in response to the rotation of said rollers.

6. The ball mill of claim 4 wherein said rotational member is a generally circular disk having an outer edge contacting said end wall of said ball mill can at a contact point, said disk being supported in said mounting assembly both for non-eccentric rotation and for pivotal movement so that a projection of said disk onto said end wall in a direction containing the plane of said disk is perpendicular to a line joining said contact point and a center of said end wall.

7. The ball mill of claim 6 wherein said mounting assembly comprises a mounting fixture having a bore hole formed therein, a post inserted within said bore hole, said post being capable of rotating within said bore and having an end extending from said bore hole, at least one arm extending from said end of said post, a pin extending between said arm and said disk, said disk being mounted perpendicular to said end wall both for non-eccentric rotation about said pin and for pivotal movement as the result of the rotation of said post within said bore hole.

8. The ball mill of claim 4 wherein said rotational member is a generally spherical ball bearing having an outer surface contacting said end wall.

9. The ball mill of claim 8 wherein said mounting assembly comprises a ball bearing socket supporting said ball bearing for rotation within said socket.

10. A ball mill comprising:

a support frame;

a generally cylindrical ball mill can having a pair of end walls, a cylindrical side wall, and a longitudinal axis of symmetry;

a can rotating assembly mounted on said support frame adapted to contact said cylindrical side wall when said ball mill can is supported thereon, said can being rotated about its axis of symmetry when supported with its cylindrical side wall in contact with said can rotating assembly;

a generally circular disk having an outer edge contacting a first one of said end walls of said ball mill can at a contact point when said can is supported by said can rotating assembly, a second one of said end walls being uncontacted by a can positioning element when said can is rotated on said can rotating assembly; and a disk mount assembly supported on said frame, said disk mount assembly rotatably supporting said disk for non-eccentric rotation and for pivotal movement so that a projection of said disk onto said first end wall in a direction containing the plane of said disk is perpendicular to a line joining said contact point and the center of said first end wall, said disk, said disk mount assembly and said can rotating assembly being dimensioned and configured to accommodate a range of sizes of said ball mill can without precise positioning of said can on said can rotating assembly and adjustments by an operator.

11. The ball mill of claim 10 wherein said can rotating assembly comprises a ball mill can stand and a plurality of rotationally driven rollers rotatably mounted on said ball mill can stand, said ball mill can being supported by said rollers on a circumferential side wall of said can, said rollers frictionally engaging said circumferential side wall and thereby rotating said ball mill can in response to the rotation of said rollers.

12. The ball mill of claim 10 wherein said disk mount assembly comprises a mounting fixture having a bore hole formed therein, a post inserted within said bore hole, said post being capable of rotating within said bore and having an end extending from said bore hole, at least one arm extending from said end of said post, a pin extending between said arm and said disk, said disk being mounted perpendicular to said end wall both for non-eccentric rotation about said pin and for pivotal movement as the result of the rotation of said post within said bore hole.

* * * * *

UNITED STATES PATENT AND TRADEMARK OFFICE

CERTIFICATE OF CORRECTION

PATENT NO. : 5,373,994

DATED : December 20, 1994

INVENTOR(S) : Thomas J. Hunt

It is certified that error appears in the above-indentified patent and that said Letters Patent is hereby corrected as shown below:

Column 1, Line 25, "ball mitt" should be --ball mill--.

Column 1, Line 27, "positioned :and" should be --positioned and--.

Column 2, Line 63, "rotates:about" should be --rotates about--.

Column 3, Line 11, "disk:contacts" should be --disk contacts--.

Signed and Sealed this

Second Day of May, 1995

Bruce Lehman

*Attest:*

BRUCE LEHMAN

*Attesting Officer*

*Commissioner of Patents and Trademarks*